US008616332B2

(12) United States Patent
Witlam et al.

(10) Patent No.: US 8,616,332 B2
(45) Date of Patent: Dec. 31, 2013

(54) PORTABLE VEHICLE-STABILIZED MAST AND FALL PROTECTION SYSTEM

(75) Inventors: Mark Witlam, Gautier, MS (US); Chad Alessi, Spanish Fort, AL (US)

(73) Assignee: IHI E&C International Corporation, Houston, TX (US)

( * ) Notice: Subject to any disclaimer, the term of this patent is extended or adjusted under 35 U.S.C. 154(b) by 259 days.

(21) Appl. No.: 12/728,927

(22) Filed: Mar. 22, 2010

(65) Prior Publication Data

US 2011/0226548 A1 Sep. 22, 2011

(51) Int. Cl.
*A62B 35/00* (2006.01)

(52) U.S. Cl.
USPC ..... 182/3; 182/129

(58) Field of Classification Search
USPC ..... 182/3, 129; 135/88.06
See application file for complete search history.

(56) References Cited

U.S. PATENT DOCUMENTS

| | | | | | |
|---|---|---|---|---|---|
| 2,480,509 | A * | 8/1949 | Ripley | 135/88.13 |
| 3,780,663 | A | 12/1973 | Pettit | |
| 3,940,099 | A * | 2/1976 | McCleskey | 248/511 |
| 4,605,030 | A * | 8/1986 | Johnson | 135/88.06 |
| 5,241,977 | A * | 9/1993 | Flores et al. | 135/88.06 |
| 5,295,500 | A * | 3/1994 | Leu | 135/88.06 |
| 5,601,104 | A * | 2/1997 | Perkins | 135/88.06 |
| 5,850,843 | A * | 12/1998 | Mahood et al. | 135/88.06 |
| 5,911,399 | A * | 6/1999 | Mannion | 248/514 |
| 6,035,874 | A * | 3/2000 | Po-Chang | 135/88.06 |
| 6,089,246 | A * | 7/2000 | Barnes | 135/88.06 |
| 6,148,580 | A * | 11/2000 | Weir | 52/651.1 |
| 6,269,904 | B1 | 8/2001 | Morhaus | |
| 6,305,394 | B1 * | 10/2001 | Reese | 135/20.1 |
| 6,311,625 | B1 | 11/2001 | Ostrobrod | |
| 6,394,118 | B1 * | 5/2002 | Cikanowick et al. | 135/88.06 |
| 6,478,111 | B2 | 11/2002 | Olson et al. | |
| 6,640,727 | B2 | 11/2003 | Ostrobrod | |
| 6,715,238 | B2 * | 4/2004 | Zambelli et al. | 52/24 |
| 6,776,103 | B2 | 8/2004 | Simard et al. | |
| 6,776,259 | B1 * | 8/2004 | Murten | 182/3 |
| 7,351,155 | B2 | 4/2008 | Lickle | |
| 7,377,398 | B2 | 5/2008 | Lichinchi | |
| 7,530,626 | B2 * | 5/2009 | Rohatinovici | 296/184.1 |
| 7,604,134 | B2 | 10/2009 | Lichinchi | |
| 7,637,351 | B2 * | 12/2009 | Langsmead | 182/113 |
| 7,740,106 | B2 * | 6/2010 | Vetesnik | 182/141 |
| 7,828,116 | B2 * | 11/2010 | Vetesnik | 182/18 |
| 2001/0032435 | A1 * | 10/2001 | Austin | 52/749.12 |

(Continued)

FOREIGN PATENT DOCUMENTS

JP 2000-210389 A 8/2000

OTHER PUBLICATIONS

Thern: "Owner's Manual for the Model MB441, MB451, and MB491 Hand Operated Disc Brakes," 16 pages.

(Continued)

*Primary Examiner* — Katherine Mitchell
*Assistant Examiner* — Daniel Cahn
(74) *Attorney, Agent, or Firm* — Rothwell, Figg, Ernst & Manbeck, P.C.

(57) ABSTRACT

Deployable fall protection systems and components are disclosed for protecting against worker falls in cargo handling operations. Workers wearing harnesses are attached to a lifeline supported from overhead, the support being attached to ground-standing mast assemblies stabilized by the weight of a vehicle parked on a foot portion of the mast assembly.

8 Claims, 3 Drawing Sheets

(56) References Cited

U.S. PATENT DOCUMENTS

| | | | | |
|---|---|---|---|---|
| 2002/0100498 | A1* | 8/2002 | Schlier | 135/88.06 |
| 2006/0163002 | A1* | 7/2006 | Langsmead | 182/113 |
| 2007/0084666 | A1 | 4/2007 | NcLaughlin et al. | |
| 2007/0205047 | A1* | 9/2007 | Vetesnik | 182/3 |
| 2008/0041661 | A1* | 2/2008 | Meillet et al. | 182/13 |
| 2008/0053505 | A1* | 3/2008 | Ampoyo | 135/88.06 |
| 2008/0139326 | A1* | 6/2008 | Lickle | 472/92 |
| 2009/0211842 | A1 | 8/2009 | Baker et al. | |
| 2009/0223744 | A1 | 9/2009 | Dowie | |
| 2011/0168219 | A1* | 7/2011 | Griffith | 135/88.06 |

OTHER PUBLICATIONS

Thern: "Owner's Manual for M452 and M492Series Spur Gear Hand Winches," 28 pages.

* cited by examiner

PORTABLE VEHICLE-STABILIZED MAST AND FALL PROTECTION SYSTEM

BACKGROUND OF THE INVENTION

1. Field of the Invention

The present invention relates to portable vehicle-stabilized masts and readily deployable and configurable fall protection systems, adaptable for use in cargo-handling environments.

2. Description of the Related Art

The loading and unloading of cargo and materials from vehicles, e.g., a flat bed truck, often requires personnel to be performing strenuous activity at a level several feet above ground level. Loading and unloading requires careful balance and stepping on or around uneven standing areas while carrying or manipulating cargo and while securing and covering the cargo. Moreover, such loading and unloading often occurs outdoors and may occur in adverse weather creating windy and/or slick conditions. Also, cargo may be unwieldy, may shift, and/or have an unstable center of gravity. Thus, for workers performing the loading and unloading tasks, there is an inherent safety risk of falling from a working-level height to the ground.

The Bureau of Labor Statistics has reported that fatal work injuries involving falls number several hundred each year. The Department of Labor lists falls as one of the leading causes of traumatic occupational death, accounting for eight percent of all occupational fatalities from trauma. The Department's general guidance for worker safety provides that any time a worker is at a height of four feet or more, the worker is at risk and needs to be protected. In maritime activities, the distance is five feet and in construction, the distance is six feet. However, regardless of the fall distance, fall protection must be provided when working over dangerous equipment and machinery. In the United States, the Occupational Safety & Health Administration and the labor and safety agencies of many states regulate worksite safety and require that adequate measures be taken to protect workers from falls. Thus, there is a critical need to provide fall protection for workers who are working above ground level, such as on the bed of a flat bed truck.

Previous attempts to provide fall protection safety systems involve many trade-offs. For example, a fall prevention system available from Carbis, Inc. provides two fall prevention platforms between which a flatbed truck is driven and parked. At the press of a button, the platforms move together to sandwich the trailer in the middle. The system also may provide a platform on only one side. Such a system, however, has multiple disadvantages. First, the system is designed for permanent installation at a site rather than mobility for temporary use at various sites such as construction sites. Second, the height of the platform is fixed and cannot be raised or lowered for differing truck and load configurations. Third, ground-level workers and equipment (e.g., loading and unloading equipment) cannot access the platform side(s) of the truck bed. In a similar system from Safe Rack LLC, the platforms are mounted on wheels rather than being part of a permanent installation; however, platform height is not adjustable and ground-level access is equally impaired.

Another fall protection system, Airtek Ireland's AirMat Safety System, may be temporarily deployed at various work sites. The system provides multiple inflatable modules in various sizes to accommodate a variety of truck and trailer length combinations. The modules are inflated by a pump-driven fan to approximately the height of the truck bed and placed alongside the truck or the truck is parked adjacent to inflated modules. If a worker falls from the truck bed to an area protected by one of the modules, the worker's fall is arrested and cushioned by the module. As with the Carbis system, ground-level workers and equipment cannot easily access the side(s) of the truck bed adjacent to the inflated modules. Moreover, a power source must continually be available to operate the fan.

Systems provided by CAI Safety Systems allow a truck to park adjacent to a pair of permanently mounted "T Anchors" or mast arms. A cable or rigid rail is suspended from the T Anchors or mast arms at a height sufficiently above the truck and its cargo. A worker wearing a safety harness is tethered to the cable or rigid rail via a self-retracting lifeline. In case the worker falls, the fall is arrested by the system. Another worker must operate the self-retracting gear from its attachment point at the cable or rigid rail in order to lower the fallen worker to the ground. In an alternate arrangement interior to a building, the cable or rigid rail may be suspended from the building's overhead structure. Being permanently mounted to the ground or attached to a building structure, these systems cannot be easily deployed to temporary work sites.

Japanese Patent Application JP2000-210389 discloses a dollied strut, two of which are wheeled up to a truck and affixed to the truck at several points. Once the struts are affixed to the truck, a rope is stretched between the tops of the struts and a lifeline is used to connect the rope and an on-vehicle worker. A disadvantage of this system is that the struts must be mechanically connected to the vehicle structure upon arrival of the vehicle at the work site in order for a worker to be able to safely work on the vehicle; conversely, the vehicle cannot depart upon completion of on-vehicle work until the system is mechanically disconnected from the vehicle structure. Moreover, trucks must be modified to have reciprocal attachment points for the struts. Also, due to the positioning of strut support members on and above the truck bed, free ground-level access to the truck bed and cargo is impeded.

Thus, the systems mentioned above suffer from a number of deficiencies and disadvantages. The present invention can provide for easily deployable fall safety systems, easily configurable for use with differently-sized vehicles. Moreover the present invention does not require vehicles to be modified with attachment points and cargo areas remain accessible to ground-level personnel and equipment.

BRIEF SUMMARY OF THE INVENTION

According to one embodiment of the invention, a portable mast assembly for a fall protection apparatus is provided. The mast assembly has a foot configured to allow a vehicle wheel to be driven on and off the foot and parked on it, and a mast mounted on and extending up from the foot, the mast permitting the driving and parking on the foot and having a rigging attachment point at a distance away from the foot. The mast assembly is stabilized when the vehicle wheel is parked on the foot.

In another embodiment, there is provided a fall protection apparatus having two portable mast assemblies and a tensionable line between their rigging attachment points. The apparatus may also include a tensioner adapted for adjusting the tension of the tensionable line. In embodiments of the invention, the mast assemblies are relocatable so that the apparatus may be used with vehicles having different wheel bases.

In some embodiments, the tensioner includes a winch disposed on one of the mast assemblies. The winch may be a hand-cranked winch disposed on the mast assembly so that the hand-cranked winch is operable by a person at a ground level. The winch may include a brake configured to permit a controlled decrease in the tension of the tensionable line. In some embodiments, the tensionable line is high-strength aircraft-grade cable. In yet other embodiments, the fall protection apparatus includes a tether linkage slidably disposed on the tensionable line. In some embodiments, the apparatus includes a tether linked at a one end to the tether linkage and a worker harness linked to the other end of the tether. In some embodiments, the foot is configured to accept a lift fork for moving the mast assembly.

In yet another embodiment of the invention, a vehicle stabilized portable fall protection system is provided. The system includes first and second portable mast units, each mast unit having a base and a mast mounted on and extending vertically from the base. Each mast unit is configured to allow a vehicle to be driven upon the base. The system further includes a mast-to-mast member disposed between and attached at points of the first and second mast units distal from the base. The system is configured so that a vehicle parked upon the base of each mast unit stabilizes the system to permit the mast-to-mast member to become stably load bearing. In some embodiments, the mast-to-mast member is a cable. In some embodiments, the load is an arrest of a falling mass. In some embodiments, the mass is a person wearing a personnel harness slidably tethered to the horizontal member.

The above and other aspects and embodiments are described below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

DETAILED DESCRIPTION OF THE INVENTION

Figure 1:
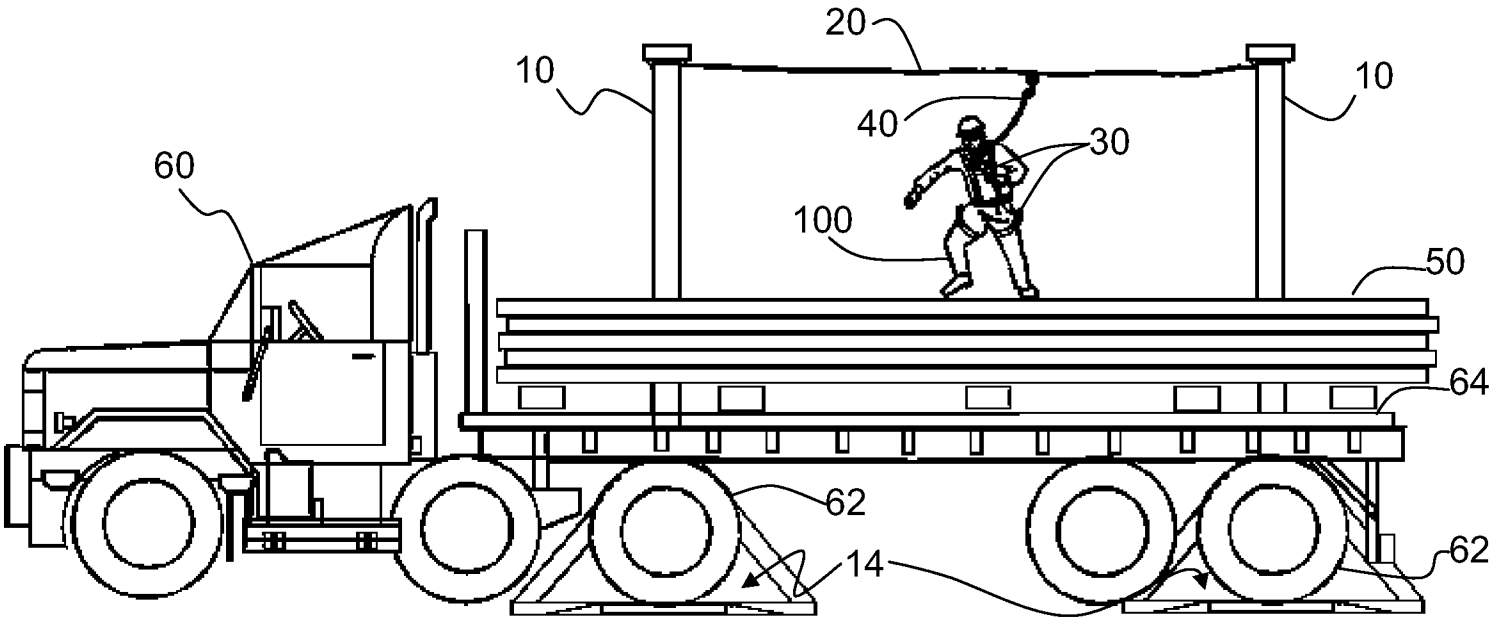
FIG. 1 illustrates an embodiment of the present invention in an exemplary usage scenario.

With reference to FIG. 1, a flatbed truck 60, carrying cargo 50 in its bed 64, is at a work site. Worker 100 is working atop the cargo 50 and truck bed 64 at a height at which a fall to the ground could result in serious injury or death. According to one embodiment of the present invention, a safety apparatus is provided in which worker 100 is wearing safety harness 30 which is connected by lifeline 40 to cable 20. Cable 20 is suspended between two mast assemblies 10. Lifeline 40 is slidably attached to the cable so that the worker can easily move between the front and rear of the truck bed 64 without having to detach from the harness 30 or lifeline 40. If worker 100 falls, the harness 30, lifeline 40, and cable 20 operate together to arrest the fall. Mast assemblies 10 remain stable because truck wheels 62 are parked on the feet 14 of mast assemblies 10. The weight of the truck 60 through wheels 62 stabilizes mast assemblies 10 against movement and deflection to ensure that cable 20 remains sufficiently tensioned for proper fall arrest.

Figure 2A:
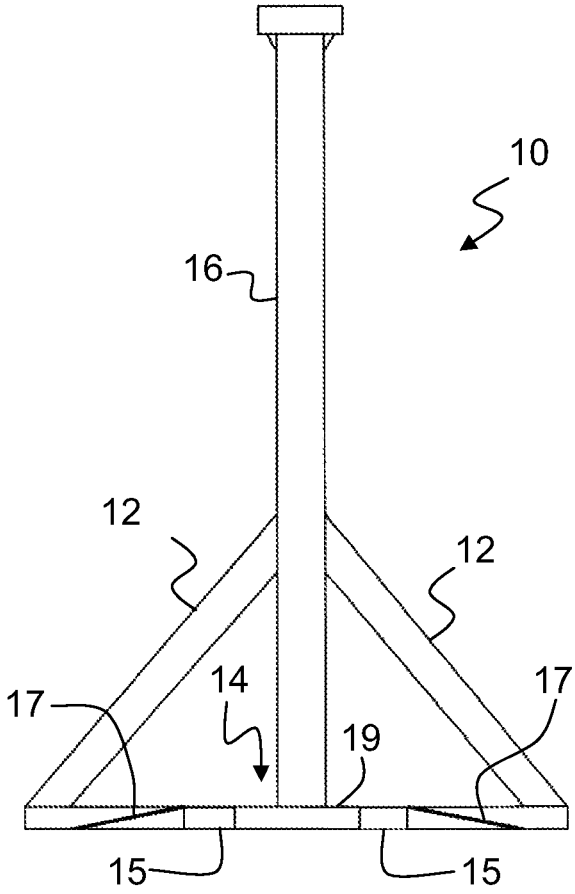
FIGS. 2A and 2B illustrate a mast in elevation and plan views, respectively, in accordance with an exemplary embodiment of the invention.
Figure 2B:
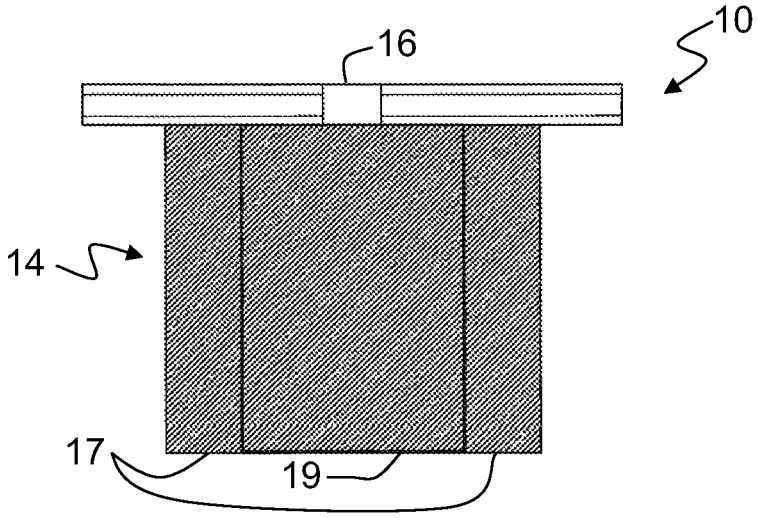

FIGS. 2A and 2B illustrate an exemplary embodiment of mast assembly 10 in elevation and plan views, respectively. Mast assembly 10 has a post or other substantially vertical member 16 attached to and extending upward from foot 14. Angular members 12 may connect foot 14 and vertical member 16 for additional stability of the mast assembly 10. Foot 14 may include receiving areas 15 which are placed and spaced so that a hand truck or fork lift may securely engage mast assembly 10 so that mast assembly 10 may be moved from work site to work site or within a work site. Foot 14 may also include drive-on and drive-off ramps 17, which can allow a truck wheel or other weight to be rolled up onto the deck 19 of foot 14. Sufficient weight (i.e., the weight of a parked vehicle) on deck 19 provides for stability of mast assembly 10 against lateral forces which would otherwise deflect or displace mast assembly 10.

In one embodiment, ramps 17 and deck 19 may be constructed of ½-inch reinforced steel. Mast assembly 10 may be further constructed of ASTM A36 compliant bars and/or tubular components. Components of mast assembly 10 may be welded or bolted together.

Figure 3A:
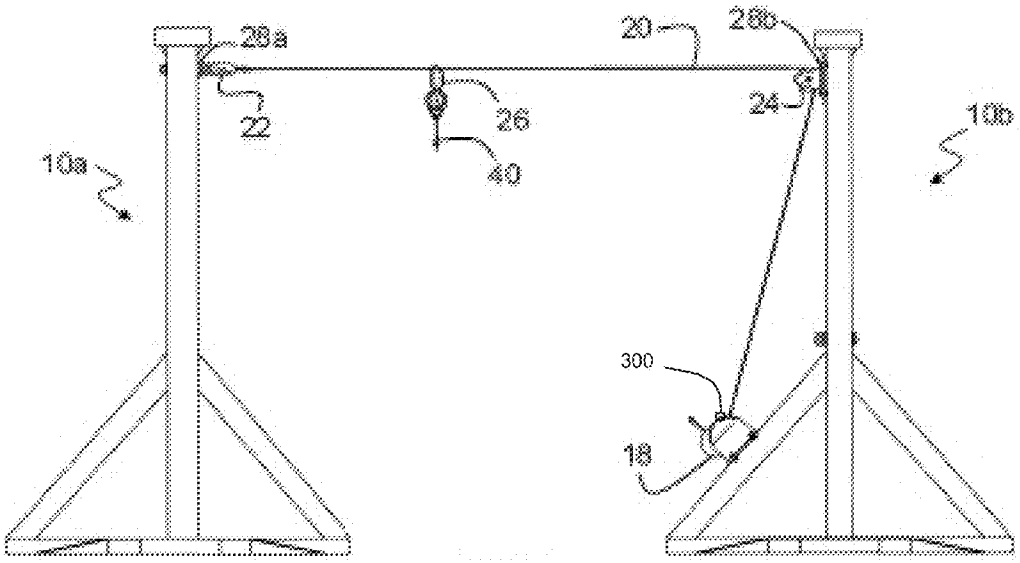
FIGS. 3A and 3B illustrate a fall protection apparatus in elevation and plan views, respectively, in accordance with an exemplary embodiment of the invention.
Figure 3B:
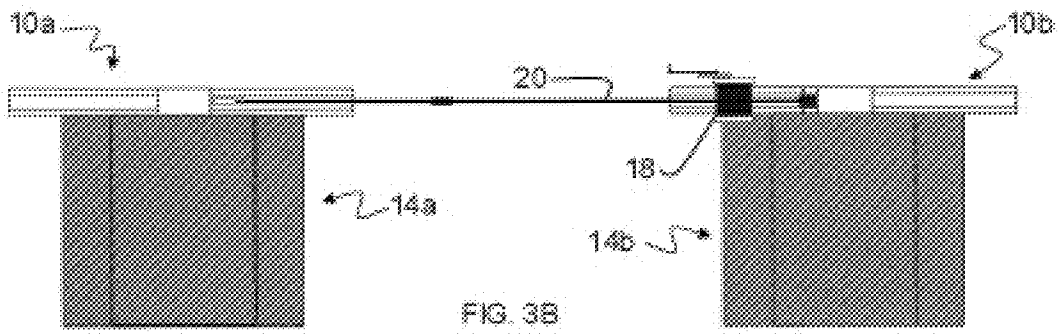

FIGS. 3A and 3B illustrate an exemplary embodiment of a fall protection system in elevation and plan views, respectively. Two mast assemblies 10*a* and 10*b* are deployed to a work site and are spaced apart in an area in which a fall safety device is required (e.g., a truck loading and unloading area). The mast assemblies 10*a* and 10*b* may be oriented and spaced apart from one another so that a truck may drive onto their feet 14*a* and 14*b* such that a forward wheel is parked on foot 14*a* of mast assembly 10*a* and a rearward wheel is parked on foot 14*b* of mast assembly 10*b*. A mast-to-mast or horizontal member 20 is attached between mast assemblies 10*a* and 10*b* at attachment points 28*a* and 28*b*, respectively. In one embodiment, horizontal member 20 is a cable attached via coupling 22, block 24, and winch 18. Coupling 22 may include an eye bolt and utility swivel hook. The cable may be tensioned between two vehicle stabilized mast assemblies 10*a* and 10*b* by operating winch 18 to establish a pre-determined tension. When the fall protection system is deployed for simultaneous use by two workers, the pre-determined tension may be 500 pounds. The cable may be ⅜-inch diameter galvanized aircraft cable having a nominal strength of 14.4 KIPS.

The fall protection system may further include one or more lifelines 40, slidably attached to horizontal member 20. In embodiments using a cable, the slidable attachment may be effected with a caribiner 26. Lifeline 40 may be a retractable lifeline which, when attached to a worker harness 30 (see FIG. 1), is played out to a length appropriate to mobility requirements of the worker in view of the height at which the worker is working.

In embodiments having winch 18, the winch may include a braking feature 300 by which the cable may be controllably detensioned. This feature allows a worker whose fall has been arrested by the fall protection system to be safely lowered to ground level by an individual operating winch 18 from ground level. An advantage of this feature is that worker can be promptly and safely lowered to the ground personnel at ground level, thus avoiding any delay in which suspension trauma, i.e., orthostatic intolerance, can set in. Suspension trauma can result in unconsciousness in minutes and subsequent fatality. In one embodiment, the winch may be a Thern winch with brake (e.g., model M492B), having a load rating of 10,000 pounds.

In one operational scenario, mast assemblies 10 are aligned and positioned a distance apart so that a flatbed truck 60 may drive wheels 62 onto feet 14 such that a forward wheel 62 is parked on a forward mast assembly 10 and a rearward wheel 62 is parked on a rear mast assembly 10. One or two carabiners 26 are clipped onto cable 20 and a corresponding number of retractable lifeline spools 40 are connected to the carabiners 26. The cable 20 is then winched to an approximate 500 pound preload. Workers ascend to the truck bed level 64 using portable stairs (not shown) and attach their body harnesses 30 to lifelines 40. In the event of a fall, personnel working at ground level can promptly detension cable 20 using braking winch 18 to lower the fallen worker 100 to ground level.

While various embodiments of the present invention have been described above, it should be understood that they have been presented by way of example only, and not limitation. Thus, the breadth and scope of the present invention should not be limited by any of the above-described exemplary embodiments.

What is claimed is:

1. A vehicle stabilized portable fall protection system comprising:

first and second portable mast units, each of said portable mast units respectively having a base and a mast mounted on and extending vertically from the base to a distal point, each of said portable mast units configured to allow a vehicle to be driven upon said bases;

each of said bases respectively including at least one receiving area capable of allowing a lifting device to engage within each of said portable mast units respectively for allowing movement of each of said portable mast units respectively; each of said bases respectively having a first inclined ramp and a deck, said first inclined ramps configured for permitting a vehicle wheel to be rolled onto the deck of each of said bases respectively to stabilize the portable fall protection system; and a cable removably disposed between and attached at the distal points of the first and second portable mast units, said cable having a personal harness slidably attached thereto; and a first vehicle, said first vehicle capable of being disposed upon the decks of said portable mast units simultaneously so that the first vehicle stabilizes the fall protection system such that the fall protection system is configured to bear a load from a user falling while wearing a personal harness.

2. The vehicle stabilized portable fall protection system of claim 1, further comprising a tensioner, said tensioner adapted for adjusting a tension of the cable.

3. The vehicle stabilized portable fall protection system of claim 2, wherein the tensioner comprises a winch disposed on the first portable mast unit.

4. The vehicle stabilized portable fall protection system of claim 3, wherein the winch is a hand-cranked winch disposed on the first portable mast unit so that the hand-cranked winch is operable by a person at a ground level.

5. The vehicle stabilized portable fall protection system of claim 3, wherein the winch includes a braking feature configured to permit a controlled decrease in the tension of the cable.

6. The vehicle stabilized portable fall protection system of claim 1, wherein said first vehicle includes a first wheelbase distance, and wherein the first and second portable mast units are configurable for a second vehicle with a second wheelbase distance to park respective first and second wheels of the second vehicle on said bases, wherein the second wheelbase distance of the second vehicle is different from the first wheelbase distance of the first vehicle.

7. The vehicle stabilized portable fall protection system of claim 1, further comprising a lifeline linkage slidably disposed on the cable.

8. The vehicle stabilized portable fall protection system of claim 1, wherein each of said bases respectively comprise a second inclined ramp portion.

* * * * *